United States Patent [19]

Karydas et al.

[11] Patent Number: 4,993,448

[45] Date of Patent: Feb. 19, 1991

[54] CRUDE OIL EMULSIONS CONTAINING A COMPATIBLE FLUOROCHEMICAL SURFACTANT

[75] Inventors: Athanasios Karydas, Brooklyn; Juliana Rodgers, Yonkers, both of N.Y.

[73] Assignee: Ciba-Geigy Corporation, Ardsley, N.Y.

[21] Appl. No.: 314,616

[22] Filed: Feb. 23, 1989

Related U.S. Application Data

[63] Continuation of Ser. No. 51,096, May 15, 1987, abandoned.

[51] Int. Cl.[5] ..... F17D 1/17

[52] U.S. Cl. ..... 137/13; 252/8.551; 252/312

[58] Field of Search ..... 137/13; 252/8.551, 312

[56] References Cited

U.S. PATENT DOCUMENTS

| | | | |
|---|---|---|---|
| 3,380,531 | 4/1968 | McAuliffe et al. | 166/371 |
| 3,491,835 | 1/1970 | Gagle | 137/13 X |
| 3,562,156 | 2/1971 | Francen | 252/357 X |
| 3,621,059 | 11/1971 | Bartlett | 252/357 X |
| 3,839,417 | 10/1974 | Waldman | 252/312 X |
| 3,943,954 | 3/1976 | Flournoy et al. | 137/13 |
| 3,952,075 | 4/1976 | Nakamura et al. | 252/351 X |
| 4,239,052 | 12/1980 | McClaflin | 137/13 |
| 4,249,554 | 2/1981 | McClaflin | 137/13 |
| 4,265,264 | 5/1981 | Sifferman | 137/13 |
| 4,299,728 | 11/1981 | Cormier et al. | 252/312 X |
| 4,570,656 | 2/1986 | Matlach et al. | 137/13 |

FOREIGN PATENT DOCUMENTS

| | | | |
|---|---|---|---|
| 658725 | 3/1963 | Canada | 252/8.513 |

*Primary Examiner*—George A. Suchfield
*Attorney, Agent, or Firm*—Michael W. Glynn

[57] ABSTRACT

A transportable crude oil in water emulsion which is stable to both breakdown and phase inversion up to at least about 50° C., containing an effective, compatible emulsion stabilizing amount of an anionic, nonionic or amphoteric fluorochemical surfactant, and optionally a hydrocarbon surfactant, and a method of transporting a crude oil in the form of such emulsion.

13 Claims, No Drawings

CRUDE OIL EMULSIONS CONTAINING A COMPATIBLE FLUOROCHEMICAL SURFACTANT

This is a continuation of application Ser. No. 051,096 filed on May 15, 1987 now abandoned.

BACKGROUND OF THE INVENTION

The present invention relates to an improved method of pumping and/or transporting viscous crude oils. More particularly, the present invention relates to the introduction into crude oils in the presence of water, of an effective amount of a surfactant package that contains at least one fluorochemical surfactant to form low-viscosity oil-in-water emulsions of the heavy crudes.

Viscosity frequently limits the rate crude oil can be produced from a well. For example, in wells that are pumped by a sucker rod string, viscous drag by the crude oil on the string slows its free fall by gravity on the downstroke. On the upstroke, this drag also slows the string, decreases oil flow through the production tubing, and increases the power required to raise oil and rod string. In some instances where the oil is highly viscous, such as the Boscan field in Venezuela, the strength of the sucker rods limits the depth at which the pump can be operated. Alternatively, hydraulic pumps can be placed at the bottom of the well, but they must still overcome the high viscous drag that requires high power oil pressures and high pump horsepower.

The downhole pump usually provides the pressure required to pump the produced oil from the wellhead to surface gathering tanks. Where viscosity is high, this may require the use of extra strength wellhead equipment (packings, gaskets, heavy walled pipes and the like) to withstand the pressures required to move such viscous oil from wellhead to storage tank.

It has been proposed heretofore to reduce the viscosity of heavy crude oils prior to pumping by introducing low viscosity crude oils, white oil, kerosene or the like into the well bore to dilute or thin the produced crude. In rod pumped wells, it is common to surround the sucker rod string with an extra tubing. Low viscosity oil is pumped down this tubing so that the string is surrounded by lower viscosity oil. This added light oil then mixes with the viscous crude near the traveling valve of the pump to lighten and thin the column of crude oil being pumped from the well through the annulus formed by the inner and the production tubings of the well. Alternatively, low viscosity oil can be pumped down hollow sucker rods and the diluted crude oil produced through the annulus between the hollow rod string and the tubing.

The resulting produced crude has reduced viscosity and is more economically transported; However, these low viscosity diluents are expensive and not always available and have to be reclaimed from the diluted crude.

Another method for reading the viscosity of heavy crudes is transporting them at elevated temperatures. This method however is very expensive because the decrease in viscosity per degree temperature increase is very low. Also, the necessary heating equipment and power requirements are costly.

Other approaches that have been suggested to reduce viscosity of asphaltenic crude deposits include the use of aqueous hydrocarbon surfactant solutions to form low viscosity oil-in-water emulsion as shown in U.S. Pat. Nos. 3,943,954, 4,265,264, 4,429,554 and 4,239,052. Such emulsions generally contain a rather high percent water for example 10–40% water, which must be removed. Removal is not always easy and yields large volumes of water contaminated with oil. High treating temperatures are required for separation of water and this results in additional expenditures. Such emulsions often become unstable at a critical flow rate and invert to high viscosity water-in-oil emulsions. As a result, pumping efficiency decreases.

It is thus an object of the present invention to obviate many of the drawbacks and deficiencies associated with the various prior art technique that are presently used in the attempt to diminish the problems associated with the production and transportation of crude oils. This object is achieved by employing a surfactant package containing at least one fluorochemical surfactant which, in the presence of water, will form an oil-in-water emulsion of the viscous crude, said emulsion having a lower viscosity than the unemulsified crude.

It is a further object of the present invention to provide a crude oil in water emulsion which is stable to breakdown or inversion up to at least about 50° C. containing an effective emulsion stabilizing amount of a compatible fluorochemical surfactant, or a combination of fluorochemical and hydrocarbon surfactant, such that the viscosity of such emulsion is less than about 50% of the viscosity of the crude oil.

It is a further object of the present invention to provide a method of transporting crude oil by emulsifying the oil with an aqueous solution containing an effective emulsion stabilizing amount of a compatible fluorochemical surfactant, or combination of a fluorochemical and hydrocarbon surfactant, to form an oil-in-water emulsion having a viscosity less than about 50% of the crude oil, and transporting said oil through a pipeline.

These and other objects of the present invention are apparent from the following disclosures.

DETAILED DESCRIPTION OF THE INVENTION

One embodiment of the present invention relates to a crude oil in water emulsion, which is stable to both breakdown and phase inversion up to at least about 50° C., said emulsion containing an effective, compatible, emulsion stabilizing amount of a fluorochemical surfactant of the formula $$(R_f)_n A_m Q \qquad (I)$$

wherein $R_f$ is an inert, stable, oleophobic and hydrophobic fluoroaliphatic group having up to about 20 carbon atoms;

n is an integer from 1 to 3;

A is a direct bond or an organic linking group and is covalently bonded to both $R_f$ and Q;

Q is an anionic, nonionic or amphoteric group; and m is an integer from 1 to 3;

wherein the amount by weight of said fluorochemical surfactant present in said emulsion being between about 0.001 and 1% by weight of said emulsion, in the presence or absence of up to about 2% by weight of a crude oil emulsion promoting hydrocarbon surfactant, with the proviso that at least about 0.005% by weight total fluorochemical and hydrocarbon surfactant is present, based upon the weight of emulsion, and wherein said emulsion contains about 15 to about 90 percent by weight water, based upon the weight of emulsion, such that the viscosity of the emulsion is less than about 50% of the viscosity of said crude oil.

Preferably the amount of water present in the emulsion is between about 20 to about 70% by weight, most preferably between about 25 to about 60% by weight. The water employed may be potable or contain a relatively high amount of dissolved solids, such as brackish water or brine. Crude oils often contain considerable amounts of water. Generally, the source of water for use in the emulsion formation is not critical.

The nature of the fluorochemical surfactant employed is generally not critical, but should be compatible with the crude oil emulsified. In particular, the fluorochemical surfactants of use are those which are soluble at least to the extent employed in the emulsion. Accordingly the fluorochemical surfactant of formula (1) should have a solubility in the emulsion of at least 0.001 percent by weight, preferably at least 0.004 percent by weight emulsion.

Preferably $R_f$ is a straight or branched chain perfluoroalkyl group of 2 to 20 carbon atoms or said perfluoroalkyl substituted by perfluoroalkoxy of 2 to 6 carbon atoms. Most preferably $R_f$ is straight chain perfluoroalkyl of 4 to 18 carbon atoms or mixtures thereof.

Preferably n is 1 to 2, most preferably 1.

A can be preferably selected from a wide array of linking groups known in the field of fluorochemical surfactants, including a direct bond, an aliphatic, aryl or araliphatic group of up to about 40 carbon atoms, which may be unsubstituted or substituted by hydroxy, lower alkoxy, lower acyloxy, aryloxy, chloro, bromo, amido, or acrylamido, and wherein the aliphatic, aryl or araliphatic group may contain on either or both ends thereof a divalent linking moiety such as oxy, thio, sulfinyl, sulfonyl, sulfonamido, lower alkyl substituted sulfonamido, poly-lower alkoxylated sulfonamido, carboxamido, lower alkyl substituted carboxamido, lower alkoxylated carboxamido, poly-lower alkoxylated carboxamido, carbonyl, oxycarbonyl, carbonyloxy, amino, lower alkylamino or poly-lower alkoxylated amino, and where the linking group is aliphatic or araliphatic, one or more of said linking moieties may interrupt said group, and wherein the valency of said organic linking group is equal to the sum of n plus m.

Preferably, m is 1 or 2, most preferably 1.

Preferably the group Q is a nonionic group such as a poly-lower alkyleneoxy substituted lower alkanol, or a lower alkyl ether, lower acryl ester, or a $C_6$–$C_{20}$ aryl ether or $C_6$–$C_{20}$ aryl ester thereof, or is a carboxy, sulfonyloxy, sulfate, thiosulfate, thiosulfinate, borate, phosphate, or phosphonate anionic group or a salt thereof, including for example, the alkali metal, alkaline earth metal, ammonium, or amine salt thereof.

The fluorochemical surfactants useful in connection with the present invention constitute a well known class of compounds, described as such in the known art, and many of which are readily commercially available from a variety of sources. Similarly, the hydrocarbon surfactants useful in combination with the instant fluorochemical surfactants constitute a well known class of widely available compounds.

Preferred hydrocarbon surfactants are those which are nonionic or anionic or mixtures thereof. Especially preferred for use with the instant fluorochemical surfactants are those conventional hydrocarbon surfactants which are known emulsification promoting agents in the field of crude oil recovery.

For purposes of this application, a hydrocarbon surfactrant is defined as a crude-oil in water emulsification promoting surfactant which is substantially devoid of oleophobic and hydrophobic fluoroaliphatic groups.

While the upper limit of the amount of hydrocarbon surfactant, if any, employed is not critical, the use of a substantial excess over 2 percent by weight is generally both costly and without any substantial economic benefit to the use of an emulsion to reduce the viscosity of the crude.

In some cases, the fluorochemical surfactant chosen exhibits a sufficiently high interfacial tension that it cannot be used alone to form a stable emulsion, but must be employed in conjunction with an emulsion promoting hydrocarbon surfactant.

In general, the fluorochemical surfactant or mixture of fluorochemical and hydrocarbon surfactant should exhibit an interfacial tension between the crude oil and water, in the amounts chosen, below about 7, preferably below about 5, and most preferably below about 3, at 20° C.

As stated above, the fluorochemical surfactant must be compatible with the crude oil emulsified. As a result, conventional cationic fluorochemical surfactants are generally unsuitable for use in the present invention, since crude oils usually contain at least minor amounts of organic acid derivatives including, but not limited to hydrocarbyl sulfonates, sulfates, carbonates, carboxylates, phenols, thiophenols or asphaltenic materials. While the presence of such acidic constituents may not interfere with corrosion inhibition properties, and the like, of such fluorochemicals, the use of such cationic materials is generally to be avoided in stable emulsion formation in accordance with the instant invention.

In a highly preferred embodiment, both the fluorochemical surfactant and the hydrocarbon surfactant are anionic, nonionic or mixtures thereof.

Preferred hydrocarbon surfactants are those of the formula $$(R)_nA_mQ \qquad \text{(II)}$$

where R is an aliphatic hydrocarbyl group of 6 to 24 carbon atoms, an aryl group of 6 to 14 carbon atoms or an alkaryl group of 7 to 24 carbon atoms, and A, n, m and Q are as defined above.

When a hydrocarbon surfactant is employed in conjunction with the fluorochemical surfactant of formula I, the hydrocarbon surfactant is preferably employed in an amount of at least 0.001%, more preferably between about 0.004% and most preferably between about 0.01 and 1%, by weight based upon the weight of emulsion.

Preferred hydrocarbon surfactants include alkyl sulfonates of 6 to 24 carbon atoms; alkyl sulfates of 6 to 24 carbon atoms; poly-lower alkoxylated aliphatic alcohols, carboxamides, esters, amines, and sulfonamides wherein the aliphatic group contains from 6 to 24 carbon atoms and the lower alkoxy units each contain 2 or 3 carbon atoms, with between 2 and 200 units; poly-lower alkoxylated alkyl phenols wherein the alkyl moiety contains between about 3 to 16 carbon atoms, the lower alkoxylated units each contain 2 or 3 carbon atoms, with between about 6 and 200 units; and poloxamers, such as polyethoxylated polypropyleneoxide containing between about 6 to about 200 ethoxylated units and about 6 to 200 propylene oxide units.

Highly preferred are polyethoxylated alkyl phenols wherein the alkyl group contains 3 to 16 carbon atoms and between about 6 to about 200 ethoxy units.

Suitable hydrocarbon surfactants include those preferred surfactants which are commercially available in bulk as crude oil water emulsifiers.

Preferred nonionic groups of Q in formula I are selected from a group with the formula $$-CH_2CH_2O)_a-(CH_2\overset{\overset{CH_3}{|}}{C}HO)_b-(CH_2CH_2O)_cH$$

wherein a is 2–40, b is 2–80 and c is 2–40.

Illustrative examples of fluorinated nonionic surfactants which can be used in the composition of this invention are:

$$C_6F_{13}CH_2CH_2SCH_2\underset{\underset{CH_2OH}{|}}{CH}-O\left(CH_2CH_2O\right)_6\left(\underset{\underset{CH_3}{|}}{CH}CH_2O\right)_{56}\left(CH_2CH_2O\right)_6H$$

$$C_6F_{13}CH_2CH_2SCH_2\underset{\underset{CH_2OH}{|}}{CH}-O(CH_2CH_2O)_7CH_3$$

FC430 (3M Company)
Zonyl FSN (DuPont)
Monflor 52 (I.C.I.)
FC-170 (3M Company)

Illustrative examples of Rf-nonionics also include compounds more fully disclosed in the following patents and incorporated herein by reference.

| United States | | German | | British |
|---|---|---|---|---|
| 2,723,999 | 1,925,555 | 2,215,388 | 2,325,855 | 1,130,822 |
| 3,621,059 | 1,966,708 | 2,230,366 | 2,334,346 | 1,148,486 |
| 3,721,700 | 2,160,852 | 2,244,028 | 2,337,638 | 1,155,607 |
| 3,883,596 | 2,215,386 | 2,250,718 | 2,501,239 | 1,176,492 |
| 3,952,075 | | | | |

| Belgium | Netherlands | Japanese |
|---|---|---|
| 817,369 | 7,009,980 | 75-157,275 |

Typical anionic groups of Q are carboxylic, ammonium or metal carboxylate where the metal is an alkali or alkali earth metal, especially sodium, potassium, calcium, magnesium and the like, sulfinic or sulfonic acid group or ammonium or a metal salt thereof or phosphonic ($OP(OH)_2$) or phosphoric ($OP(OH)_3$) acid group or ammonium or metal salt thereof.

Illustrative examples of $R_f$-anionics which can be used in the compositions of this invention are the below shown acids and their alkali metal salts. The patent numbers appearing in parenthesis are patents which more fully disclose the represented class of compounds. The disclosures of these patents are incorporated herein by reference.

| | |
|---|---|
| **Carboxylic Acids and Salts thereof** | |
| $R_fCOOH$ | Scholberg et. al. J. Phys. Chem. 57,923-5 (1953) |
| $R_f(CH_2)_{1-20}COOH$ | (Ger. 1,916,699) |
| $R_fO(CF_2)_{2-20}COOH$ | (Ger. 2,132,164) |
| $R_fO(CF_2)_{2-20}(CH_2)_{2-20}COOH$ | (Ger. 2,132,164) |
| $R_fO(CH_2)_{1-20}COOH$ | (U.S. Pat. No. 3,409,647) |
| $R_fSO_2N(C_2H_5)CH_2COOH$ | (U.S. Pat. No. 3,258,423) |
| $R_fO(CF_2O)_3CF_2COOH$ | (Fr. 1,531,902) |
| $R_fO\left[\begin{array}{c}CF_2CFO\\ \vert\\ CF_3\end{array}\right]CF_2COOH$ | (Fr. 1,537,922) |
| **Phosphonates, Phosphates, Related Phosphoro Derivatives and Salts Thereof** | |
| $R_fPO(OH)_2(R_f)_2PO(OH)$ | (Ger. 2,110,767) |
| $R_fSO_2N(Et)\ C_2H_4OPO(OH)_2$ | (Ger. 2,125,836) |
| $R_fCH_2OPO(OH)$ | (Ger. 2,158,661) |
| $C_8F_{15}OC_6H_4CH_2PO(OH)_2$ | (Ger. 2,215,387) |
| $R_fOC_6H_4CH_2PO(OH)_2$ | (Ger. 2,230,366) |
| **Others (and Salts Thereof)** | |
| $R_fSO_2N(CH_3)C_2H_4OSO_3H$ | (Ger. 1,621,107) |
| $R_fC_6H_4OH$ | (U.S. Pat. No. 3,475,333) |
| $R_f(CH_2)_{1-20}S_2O_3Na$ | (Ger. 2,115,139) |
| $R_f(CH_2)_{1-20}SO_2N(CH_3)CH_2CH_2S_2O_3Na$ | (Ger. 2,115,139) |
| $R_f\ldots SO_2H$ | (U.S. Pat. No. 3,562,156) |
| $R_fO(CF(CF_3)CF_2O)CF(CF_3)CON(CH_3)CH_2COOH$ | (U.S. Pat. No. 3,798,265) |
| $(C_2F_5)_2(CF_3)CCH_2COOH$ | (Brit. 1,176,493) |
| $C_{10}F_{19}OC_6H_4CON(CH_3)CH_2COOH$ | (Brit. 1,270,662) |
| $R_f(CH_2)_{1-3}SCH(COOH)CH_2COOH$ | (U.S. Pat. No. 3,706,787) |
| $R_f(CH_2)_{1-12}S(CH_2)_{1-17}COOH$ | (Ger. 2,239,709) (U.S. Pat. No. 3,172,910) |
| **Sulfonic Acids and Salts thereof** | |
| $R_fSO_3H$ | (U.S. Pat. No. 3,475,333) |
| $R_fC_6H_4SO_3H$ | (Ger. 2,134,973) |
| $R_f(CH_2)_{1-20}SO_3H$ | (Ger. 2,309,365) |
| $R_fSO_2NHCH_2C_6H_4SO_3H$ | (Ger. 2,315,326) |
| $RSO_2N(CH_3)(C_2H_4O)_{1-20}SO_3H$ | (S.A. 693,583) |

-continued

| | |
|---|---|
| $R_fCH_2CH_2OCH_2CH_2CH_2SO_3H$ | (Can. 842,252) |
| $R_fOC_6H_4SO_3H$ | (Ger. 2,230,366) |
| $C_{12}F_{23}OC_6H_4SO_3H$ | (Ger. 2,240,263) |
| $(C_2F_5)_3CO(CH_2)_3SO_3H$ | (Brit. 1,153,854) |
| $CF_3(C_2F_5)_2CO(CH_2)_2SO_3H$ | (Brit. 1,153,854) |
| $(C_2F_5)_2(CF_3)CCH{=}C(CF_3)SO_3H$ | (Brit. 1,206,596) |
| $R_fOCF(CF_3)CF_2OCF(CF_3)CONHCH_2SO_3H$ | (U.S. Pat. No. 3,798,265) |

The amphoteric fluorinated surfactants included in the composition of the present invention can be represented by the formula:

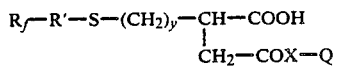

and its isomer

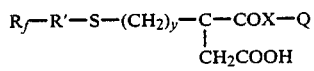

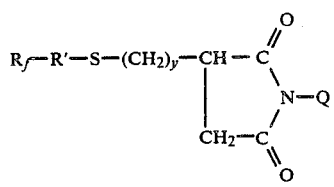

wherein $R_f$ is straight or branched chain perfluoroalkyl of 3 to 18 carbon atoms or said perfluoralkyl substituted by perfluoroalkoxy of 2 to 6 carbon atoms, $R^1$ is branched or straight chain alkylene of 1 to 12 carbon atoms, alkylenethioalkylene of 2 to 12 carbon atoms, alkyleneoxyalkylene of 2 to 12 carbon atoms or alkyleneiminoalkylene of 2 to 12 carbon atoms where the nitrogen atom contains as a third substituent, hydrogen or alkyl of 1 to 6 carbon atoms, y is 1 or zero, X is oxygen or -NR, wherein R is hydrogen, lower alkyl of 1 to 6 carbon atoms, hydroxy-alkyl of 1 to 6 carbon atoms, or R together with Q forms a piperazine ring; and Q is a nitrogen containing group selected from 1. an aliphatic amino group selected from

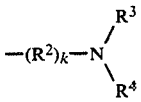

(1a)

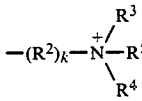

(1b)

and

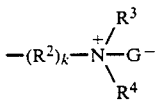

(1c)

wherein $R^2$ is a linear or branched alkylene of 2 to 12 carbon atoms, oxygen or sulfur interrupted linear or branched alkylene of up to 60 carbon atoms, or hydroxyl substituted alkylene. Preferably $R^2$ is a straight chain or branched alkylene of 2 to 5 carbon atoms;

k is 1 or zero, with the provision, that if X is oxygen k is 1;

$R^3$ and $R^4$ are independently of each other hydrogen, alkyl, alkenyl or substituted alkyl, or alkenyl, each of 1 to 20 carbon atoms; phenyl, alkyl or halogen substituted phenyl of 6 to 20 carbon atoms, polyethoxy or polypropoxy of 2 to 20 alkoxy units, with the proviso that if X is oxygen, $R^3$ and $R^4$ are not hydrogen. The alkyl or alkenyl substituents can be hydroxyl, carboxyl, halogen, alkylene dialkylphosphonate such as methyle-diethylphosphonate or a group

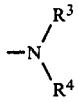

Phenyl substituents can be methyl, halogen or hydroxyl. Preferably $R^3$ and $R^4$ are lower alkyl groups of 1 to 4 carbons.

A− is any anion which forms ammonium salt of the formula $NH_4{+}A{-}$.

Anion A− is derived from alkyl halides, benzene or chlorobenzene sulfonate esters of alkyl alcohols and methyl and ethyl sulfates. A− is preferably Cl− or $CH_3CH_2OSO_3$−.

$R^5$ is hydrogen, an alkyl group or hydroxylalkyl group, aralkyl or groups of the formula $-(CH_2)_n-COO$-alkyl, said alkyl group having 1 to 18 carbons. Preferably, $R^5$ is methyl, ethyl, propyl, butyl or benzyl.

G− is selected from the groups

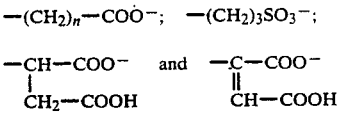

where n is 1 to 5.

2. cyclic amino groups selected from

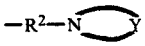

(2a)

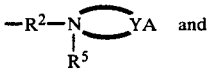

(2b)

and

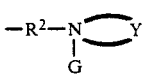

(2c)

wherein Y is a diradical group of the formulae;

$-(CH_2)_4-$
$-(CH_2)_5-$
$-(CH_2)_2-O-(CH_2)_2-$

-continued $$-(CH_2)-\underset{R^7}{\underset{|}{CH}}-\underset{R^8}{\underset{|}{N}}-(CH_2)_z,$$

wherein $R^2$, $R^5$, A− and G− are as defined above, $R^7$ and $R^8$ are independent hydrogen, a lower alkyl or hydroxy-lower alkyl group of 1 to 6 carbon atoms, with the provision, that if X is oxygen, $R^8$ cannot be hydrogen.

3. aromatic amino groups selected from

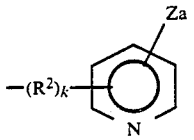
(3a)

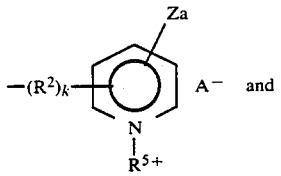
(3b)

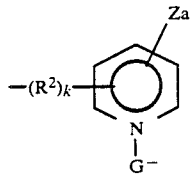
(3c)

4. fused-ring aromatic amino group selected from

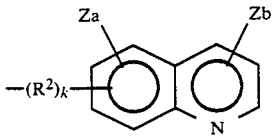
(4a)

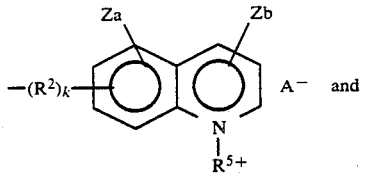
(4b)

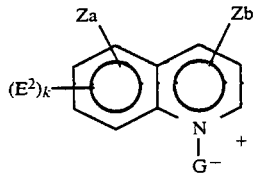
(4c)

wherein

Z is halogen or methyl, a+b is an integer from 0–3; and 5. a heterocyclic amino group of the formula $$-(R^2)k-E \quad (5a)$$

$$-(R^2)_k-E^+-R^5A^- \quad (5b)$$

$$-(R^2)_k-E^+-G^- \quad (5c)$$

where k is one or zero and

E is selected from N-hydroxyalkyl or N-amino-alkyl, substituted pyrrole, pyrazole, imidazole, triazole, indole or indazole, hydroxyalkyl and aminoalkyl ring-substituted pyridazine, pyrimidino, pyrazino or quinoxalino.

Illustrative examples of amphoteric fluorinated surfactants are:

N-[3-(dimethylamino)propyl]-2,(3)-(1,1,2,2-tetrahydroperfluoroalkylthio) succinamic acid, N-methyl-N-(2'-N,N'-dimethylaminoethyl)-2-(3)-(1,1,2,2-tetrahydroperfluoroalkylthio)succinamic acid, N-(2-dimethylaminoethyl)-2,(3)-(1,1,2,2'-tetrahydroperfluoroalkylthio) succinamic acid, 2(3)-(1,1,2,2-tetrahydroperfluorodecylthio)succinic acid-mono[2-N,N-methylaminoethyl]ester, 2-(3)-(1,1,2,2-tetrahydroperfluorodecylthio)succinic acid-mono-(2'quinolinoethyl)ester, N,N'-bis[(n-propyl-3)-(1,1,2,2-tetrahydroperfluorooctylthio) succinamic monoamido]piperazine, N-[3-(dimethylamino)propyl]-2,(3)-(heptafluoroisopropoxy-1,1,2,2-tetrahydroperfluoroalkylthio)succinamic acid, 2-(1,1,2,2-tetrahydroperfluoroctylthio)N-[3-dimethylamine)propyl]-2-methyl succinamic acid, N-ethyl-N-(2'-N',N'-dimethylaminoethyl)-2,(3)-(1,1,2,2-tetrahydroperfluoro alkylthio)succinamic acid, N-[3-(dimethylamino)propyl]-2(3)-(1,1,2,2-tetrahydroperfluorooctylthio) succinamic acid, and N-methyl-N-(2'-N'N'-dimethylaminopropyl)-2,(3)-(1,1,2,2-tetrahydroperfluoroalkylthio)succinamic acid, N-[3-(dimethylamino)propyl]-2(3)-(1,1,2,2-tetrahydroperfluorodecylthio) succinamic acid, and N-[3-(dimethylamino)propyl]-2(3)-(1,1,2,2-tetrahydroperfluorodecylthio)succinamic acid, Reaction product of N-[3-(dimethylamino)propyl]-](3)-(1,1,2,2-tetrahydroper fluorodecylthio)succinamic acid and propane sultone, Reaction product of N-[3-dimethylamino)propyl]-2(3)-(1,1,2,2-tetrahydroperfluorooctylthio) succinamic acid and chloroacetic acid, or Zonyl FSB (DuPont).

The emulsions of the present invention are characterized both by (1) their stability to breakdown or inversion even under conditions of turbulent flow up to temperatures of at least about 50° C., and (2) the ease at which the emulsion can be broken cleanly to yield the crude oil and water at temperatures in excess of 50° C., preferably between about 55 and about 75° C. The ease at which the emulsion can be clearly broken at elevated temperatures is unexpected and surprising, and is highly advantageous. For example, there is generally no need for the addition of de-emulsification materials, and the separated aqueous phase can therefore be simply recycled if desired or convenient.

A further embodiment of the present invention relates to a method of transporting a viscous crude oil by converting the oil into an aqueous crude oil in water low viscosity emulsion by contacting said oil with an aqueous solution containing the requisite amounts of fluorochemical surfactant, optionally with hydrocarbon surfactant, under sufficiently turbulent conditions to induce emulsion formation, and transporting the oil in the form of the resulting emulsion. Where the interfacial tension is sufficiently low, e.g. below 2, emulsification may occur spontaneously.

After the oil emulsion is transported to a convenient site, e.g. by pipeline, the emulsion is then broken and the crude oil recovered for further processing by heating the emulsion in excess of 50°.

The following test methods and examples are given for illustrative purposes only and are not to be construed as limiting the scope of the invention. All parts are by weight unless otherwise indicated.

DESCRIPTION OF LABORATORY TEST METHOD #1

Control

The crude oil is placed in a closed container. The container and its contents are placed in a draft oven at 50° C. for 15 minutes. The container is then opened and the oil is sheared using a Polytron® mixer at high speed for one minute to obtain a homogeneous oil. Viscosity measurements are conducted using the Brookfield Viscometer Model RVF equipped with spindle #4. The spindle is attached to the viscometer and lowered into the contents of the container. The oil is stirred at 20 RPM for 5 minutes. The temperature is recorded and the viscosity is measured at 20 and 10 RPM.

Doped Sample

The above procedure is repeated with the addition of surfactants and water to form an emulsion. An oil-soluble surfactant is added to the oil in the container. Water, containing a water-soluble surfactant at a predetermined concentration, is added to the oil at a certain percent ratio. The thermal treatment and viscosity measurements are conducted according to the above procedure.

DESCRIPTION OF LABORATORY TEST METHOD #2

A Fann 35A/SR12 Viscometer equipped with a closed-end rotor cup $R_1$, a hollow bob $B_1$, a double-wall circulating cup and a circulating bath is employed for viscosity measurements. Approximately 22.5 g of oil are placed directly into the closed-end rotor cup. To this are added 250 ppm of of an oil-soluble surfactant followed by 7.5 g of a 0.1% water solution containing a water-soluble surfactant. The closed-end rotor cup and its contents are weighed, placed in a draft oven at 50° C. for 15 minutes and then reweighed to assure zero weight loss. The rotor cup is attached to the viscometer and lowered into the double-wall circulating cup which contains water as a heating medium. The temperature is controlled by a circulating bath that is connected to the jacket of the double-wall circulating cup. The doped oil/water mixture is allowed mix and equilibrate at 25° C. for 5 minutes at 300 RPM. The viscosity is measured at 300, 200 and 100 RPM at 25° C. The emulsion mixture is then sheared at 600 RPM (shear rate=1021 $sec^{-1}$) for 5 minutes and the viscosity is remeasured. The viscosity measurments are repeated at higher temperatures.

EXAMPLES 1-6

The examples are comparative and illustrate the viscosity reduction of crude oil obtained by the addition of a surfactant package containing one or more fluorinated compounds to an oil/water mixture. A sample of Canadian crude oil alone (control) and a combination of Canadian crude (3 parts) doped with 250 ppm of compound A and water (1 part) doped with 250 ppm of Compound B are prepared and the viscosities are measured according to Laboratory Test Method #1. The results are summarized in Table I.

TABLE I

| Example | Surfactant Package Compound A[1] |
|---|---|
| Control | None |
| 1 | $C_6F_{13}CH_2CH_2SCH_2CH(CH_2OH)—O—(CH_2CH_2O)_6—(CH(CH_3)CH_2O)_{56}—(CH_2CH_2O)_6H$ |
| 2 | Compound A from Example 1 |
| 3 | FC ® -430[3] |
| 4 | Pluronic ® L-101[4] |
| 5 | Triton ® X-100[5] |
| 6 | Triton ® X-100[5] |

| Example | Surfactant Package Compound B[1] | Temperature (°C.) | RPM | Visc. (cp) | % Reduction of Control Visc. |
|---|---|---|---|---|---|
| Control | None | 27.0 | 20 | 15400 | — |
| | | | 10 | 15600 | — |
| 1 | $C_6F_{13}CH_2CH_2SCH_2CH_2\overset{O}{\overset{\|}{C}}HN—C(CH_3)_2CH_2SO_3^{\ominus}Mg^{\oplus\oplus}/_2$ | 25.0 | 20 | 800 | 95 |
| | | | 10 | 900 | 94 |
| 2 | Steol ® CS-760[2] | 25.8 | 20 | 150 | 99 |
| | | | 10 | 100 | 99 |
| 3 | Steol ® CS-760[2] | 25.7 | 20 | 400 | 97 |
| | | | 10 | 400 | 97 |
| 4 | Compound B from Example 1 | 25.8 | 20 | 150 | 99 |
| | | | 10 | 200 | 99 |
| 5 | Compound B from Example 1 | 26.3 | 20 | 150 | 99 |
| | | | 10 | 100 | 99 |
| 6 | FC ® -90[3] | 26.8 | 20 | 800 | 97 |

TABLE I-continued

| | | | |
|---|---|---|---|
| | 10 | 400 | 97 |

[1]Concentration = 250 ppm.
[2]Stepan Chemical Company, believed to contain sodium salts of linear fatty alcohol ether sulfates.
[3]3M Company, believed to contain perfluoroalkyl esters.
[4]BASF Wyandotte Corporation, believed to contain $HO(CH_2CH_2O)_6(CH(CH_3)CH_2O)_{56}(CH_2CH_2O)_6H$.
[5]Rohm and Haas Company, believed to contain alkylaryl polyether alcohols.

EXAMPLE 7-8

The example is comparative and illustrates the reduction of crude oil viscosity obtained by the addition of a surfactant package of fluorinated compounds to an oil containing water. The viscosity of Venezuelan crude oil which contains 15% water is measured. To this crude is added 500 ppm of Compound C and 500 ppm of Compound D. The viscosities are then remeasured. The results are tabulated in Table II.

TABLE II

| Example # | Surfactant Package: Compound C | Surfactant Package: Compound D |
|---|---|---|
| Control 7 | None | None |
| | Compound A from Example 1 | Compound B from Example 1 |
| Control 8 | None | None |
| | $C_8F_{17}(CH_2)_2SCH_2CH(CH_2OH)-O-(CH_2CH_2O)_6(CHCH_2O)_{56}(CH_2CH_2O)_6H$ ($CH_3$) | Compound B from Example 1 |

| Example # | Concentration | Temperature (°C.) | Viscosity[1] (cP) | % Viscosity Reduction of Control |
|---|---|---|---|---|
| Control 7 | — | 22 | 98000[2] | — |
| | 500 ppm each | 22 | 3500 | 96 |
| Control 8 | — | 22 | 86000[2] | — |
| | 500 ppm each | 22 | 6300 | 93 |

[1]Measured using Brookfield Viscometer Model AVF, Spindle #6 10 RPM.
[2]The difference in viscosity values on the crude alone in Examples 7 and 8 is due to the varying amount of water naturally present in the crude.

EXAMPLE 9

The example is comparative and demonstrates the superiority of a fluorinated surfactant over a hydrocarbon surfactant in maintaining a stable oil-in-water emulsion at higher temperatures. Two oil/water mixtures are prepared and doped according to Laboratory Test Method #2. One sample contains a hydrocarbon surfactant and consists of Canadian crude (3 parts) doped with 250 ppm Triton X-100®[1] mixed with water (1 part). The other sample is similar except that it also contains 250 ppm of a fluorinated surfactant, compound B from Example 1, in the water portion. The viscosity measurements are conducted as previously described (without high shearing). A sharp decrease in viscosity is in indicative of an emulsion split. The results are summarized in Table III.

[1] from Rohm and Haas Company, believed to contain alkylaryl polyester alcohols.

TABLE III

| Surfactant Package | Concentration | Temperature (°C.) | Viscosity (cPs) 300 RPM | Viscosity (cPs) 100 RPM |
|---|---|---|---|---|
| Triton ® X-100[1] | 250 ppm | 25.2 | 21 | 21 |
| | | 29.1 | 28 | 30 |
| | | 40.5 | 18 | 21 |
| | | 50.6 | 9 (emulsion split) | 9 (emulsion split) |
| Triton ® X-100[1]/ Compound B from Example 1 | 250 ppm each | 25.5 | 30 | 27 |
| | | 30.6 | 30 | 24 |
| | | 40.8 | 27 | 21 |
| | | 50.6 | 23 | 21 |
| | | 70.0 | 14 (emulsion split) | 9 (emulsion split) |
| Triton ® X-100[1]/ Compound B from Example 1 | 100 ppm/ 100 ppm | 25.3 | 30 | 28 |
| | | 29.7 | 28 | 24 |
| | | 40.0 | 25 | 21 |
| | | 50.2 | 23 | 20 |
| | | 70.0 | 12 | 9 (emulsion split) |

[1]from Rohm and Haas Company, believed to contain alkylaryl polyester alcohols.

EXAMPLE 10

The example is comparative and illustrates the stability of the oil-in-water emulsion containing a fluorochemical surfactant, even after extensive shearing. A combination of Canadian crude (3 parts) doped with 250 ppm Triton ® X-100[1] and water (1 part) containing 250 ppm of Compound B from Example 1 is prepared. The viscosity is measured before and after shearing (shear rate = 1021 $sec^{-1}$) as described in Laboratory Test Method #2. The consistency of the sheared emulsion viscosity with the initial emulsion viscosity at each temperature is indicative of a stable oil-in-water emulsion. The results are summarized in Table IV.

[1] from Rohm and Haas Company, believed to contain alkylaryl polyether alcohols.

TABLE IV

| Temperature (°C.) | 300 RPM Initial Viscosity (cPs) | 300 RPM Sheared Viscosity[2] (cPs) | 200 RPM Initial Viscosity (cPs) | 200 RPM Sheared Viscosity[2] (cPs) | 100 RPM Initial Viscosity (cPs) | 100 RPM Sheared Viscosity[2] (cPs) |
|---|---|---|---|---|---|---|
| 25.5 | 37 | 35 | 30 | 30 | 27 | 27 |
| 30.6 | 30 | 28 | 27 | 24 | 24 | 21 |
| 40.8 | 27 | 24 | 26 | 21 | 21 | 18 |
| 50.6 | 23 | 22 | 25 | 22 | 21 | 21 |

[2]Oil/water mixture was sheared for 5 minutes, shear rate = 1021 $sec^{-1}$.

What is claimed is:

1. A crude oil in water emulsion, which is stable to both breakdown and phase inversion up to at least about 50° C., said emulsion containing an effective, compatible, emulsion stabilizing amount of a fluorochemical surfactant of the formula $$(R_f)_nA_mQ \quad (I)$$

wherein $R_f$ is an inert, stable, oleophobic and hydrophobic fluoroaliphatic group having up to about 20 carbon atoms;

n is an integer from 1 to 3;

A is a direct bond or an organic linking group and is covalently bonded to both $R_f$ and Q;

Q is an anionic, nonionic or amphoteric group; and m is an integer from 1 to 3;

wherein the amount of weight of said fluorochemical surfactant present in said emulsion being between about 0.001 and 1% by weight of said emulsion, in the presence or absence of up to about 2% by weight of a crude oil emulsion promoting hydrocarbon surfactant, with the proviso that at least about 0.005% by weight total fluorochemical and hydrocarbon surfactant is present, based upon the weight of emulsion, and wherein said emulsion contains about 15 to about 90 percent by weight water, based upon the weight of emulsion, such that the viscosity of the emulsion is less than about 50% of the viscosity of said crude oil, and wherein said emulsion spontaneously breaks down into an aqueous and crude oil phase at a temperature between about 55° and 75° C.

2. An emulsion according to claim 1, wherein the amount of water present is between about 20 to about 70% by weight, based upon the weight of emulsion.

3. An emulsion according to claim 1, wherein the amount of water present is between about 25 to about 60% by weight based on the weight of emulsion.

4. An emulsion according to claim 1, wherein $R_f$ is straight chain perfluoroalkyl of 4 to 18 carbon atoms or mixtures thereof.

5. An emulsion according to claim 4, wherein n is 1, and m is 1.

6. An emulsion according to claim 1, wherein the fluorochemical surfactant is anionic or nonionic.

7. An emulsion according to claim 1, wherein the hydrocarbon surfactant is employed in an amount of at least 0.001%.

8. An emulsion according to claim 1, wherein the hydrocarbon surfactant is of the formula $$(R)_nA_mQ \quad (II)$$

wherein

R is an aliphatic hydrocarbyl group of 6 to 24 carbon atoms, an aryl group of 6 to 14 carbon atoms, or an alkaryl group of 7 to 24 carbon atoms A is a direct bond or an organic linking group and is covalently bonded to both R and Q;

Q is an anionic, nonionic or amphoteric group;

n is from 1 to 3, and m is from 1 to 3.

9. An emulsion according to claim 8, wherein said fluorochemical surfactant said hydrocarbon surfactant are independently anionic or nonionic.

10. An emulsion according to claim 9, wherein both said fluorochemical surfactant and said hydrocarbon surfactant are nonionic.

11. A method of transporting a normally viscous crude oil by converting said oil into an aqueous emulsion according to claim 1 by the addition of water and said fluorochemical surfactant and optionally said hydrocarbon surfactant under sufficiently turbulent conditions to induce crude oil in water emulsion formation, transporting said oil in the form of said emulsion and breaking said emulsion to recover said crude oil by heating the emulsion in excess of 50° C.

12. A method according to claim 11, wherein the emulsion is broken by heating the emulsion between about 55° C. and 75° C.

13. A method according to claim 11, wherein the emulsion is transported by passage through a pipeline.

* * * * *